US005277577A

United States Patent [19]

Schachter et al.

[11] Patent Number: 5,277,577

[45] Date of Patent: Jan. 11, 1994

[54] ONE-WAY VALVE FOR FLUIDS

[75] Inventors: Friedrich Schachter, Vienna, Austria; Michel Doucet, Redon, France

[73] Assignee: Minitek Feinmechanische Produkte Gesellschaft m.b.H., Vienna, Austria

[21] Appl. No.: 746,935

[22] Filed: Aug. 19, 1991

[51] Int. Cl.[5] ..... F23D 14/28

[52] U.S. Cl. ..... 431/344; 251/900; 251/359; 222/3

[58] Field of Search ..... 431/344, 277; 251/359, 251/900, 350, 332, 333, 334, 322, 349, 344, 347; 222/3

[56] References Cited

U.S. PATENT DOCUMENTS

| | | | |
|---|---|---|---|
| 2,777,735 | 1/1957 | Green | 251/353 X |
| 2,928,646 | 3/1960 | Ashbrook | 251/364 X |
| 2,959,188 | 11/1960 | Kepner | 251/364 X |
| 3,074,601 | 1/1963 | Kuffer | 251/353 X |
| 3,085,590 | 4/1963 | McIlhenny | 251/364 X |
| 3,368,111 | 2/1968 | Rabe et al. | 431/344 X |
| 3,414,363 | 12/1968 | Rosfelder | 431/255 X |
| 3,533,721 | 10/1970 | Hocq | 431/344 |
| 3,626,977 | 12/1971 | Riley | 251/900 X |
| 4,036,579 | 7/1977 | Marynissen . | |
| 4,077,429 | 3/1978 | Kimball | 431/344 X |
| 4,255,119 | 3/1981 | White et al. . | |
| 4,316,600 | 2/1982 | Parise et al. | 251/900 X |
| 4,332,549 | 6/1982 | Fuller | 431/344 |
| 4,441,687 | 4/1984 | Pauliukonis | 251/900 X |
| 4,496,309 | 1/1985 | Schächter . | |
| 4,560,345 | 12/1985 | Schächter . | |
| 4,680,007 | 7/1987 | Schächter . | |
| 4,773,849 | 9/1988 | Schächter . | |
| 4,889,482 | 12/1989 | Schächter . | |
| 4,938,376 | 7/1990 | Fieseler et al. | 251/900 X |
| 5,002,482 | 3/1991 | Fairbanks et al. . | |

FOREIGN PATENT DOCUMENTS

| | | |
|---|---|---|
| 1453313 | 9/1966 | France . |
| 115254 | of 1989 | Taiwan . |
| 1154553 | 6/1969 | United Kingdom . |

*Primary Examiner*—Carl D. Price

*Attorney, Agent, or Firm*—Peter G. Dilworth; Rocco S. Barrese; Joseph J. Catanzaro

[57] ABSTRACT

A valve is disclosed for selectively permitting passage of fluid media such as gaseous fuel, from a first location to a second location. A valve body has one end portion defining a cylindrical inner wall surface and a flat annular seat extending inwardly thereof. An end plug is positioned for axial movement toward and away from the valve seat and an annular seal ring is positioned between the end plug and the valve seat and adapted to provide gaseous sealing contact between the end plug and the valve body at a plurality of locations when the end plug is moved to a first closed position which prevents gaseous communication between the first and second locations. In one embodiment the seal ring moves axially with the end plug and in another embodiment the seal ring remains seated and the end plug moves in the axial direction away from the seal ring. Other embodiments provide alternative means to direct the gaseous media from the first location to the second. One application is disclosed wherein the valve is provided in a gas lighter for selectively permitting gaseous fuel to flow from the fuel reservoir to the burner nozzle.

30 Claims, 5 Drawing Sheets

FIG. 2
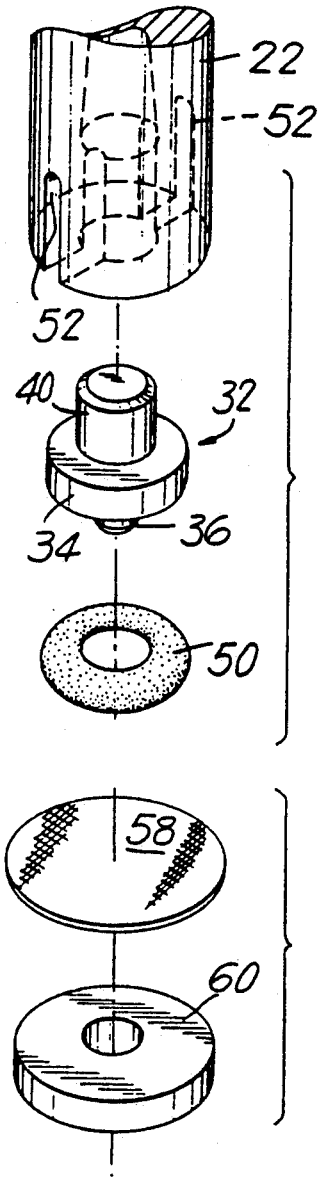
FIG. 2A
FIG. 3
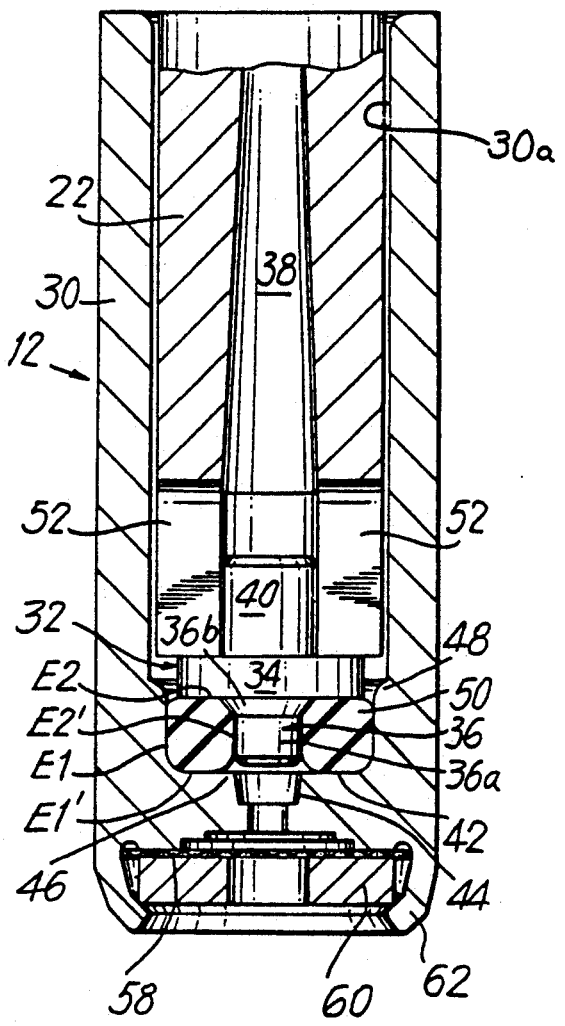

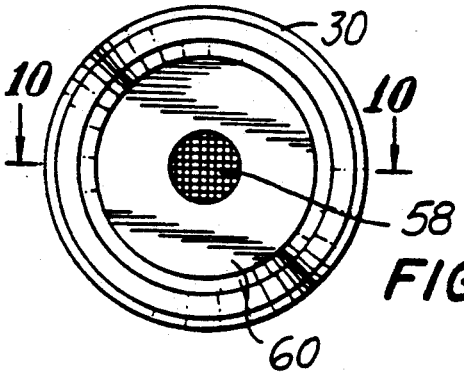
FIG.9
FIG.12
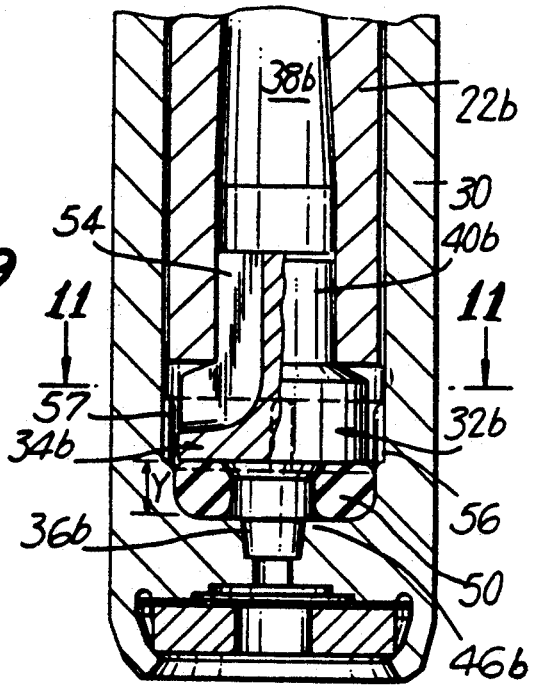
FIG.10
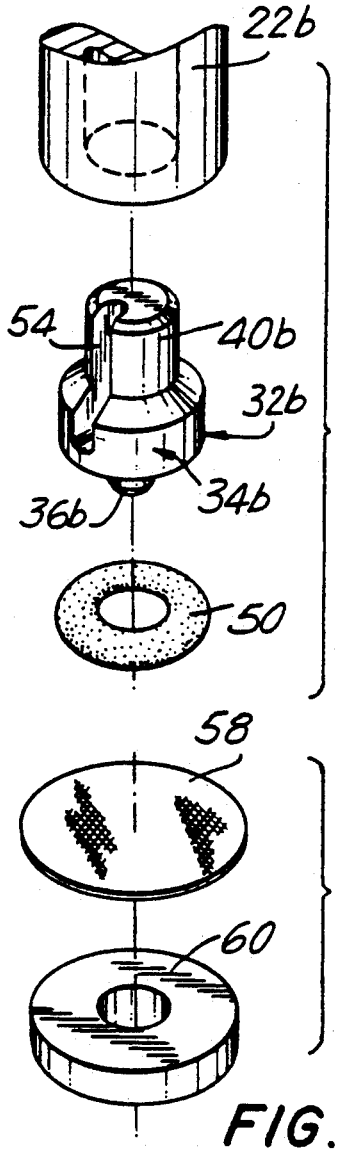
FIG.12A
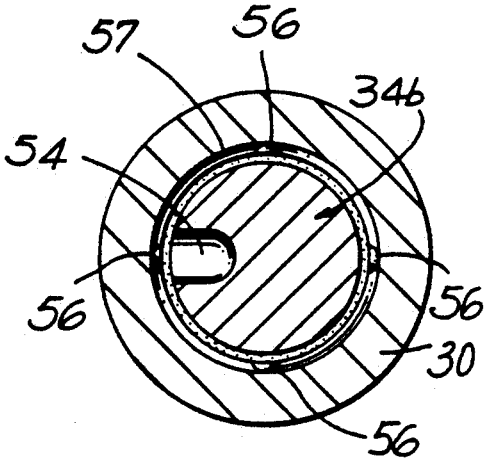
FIG.11

ONE-WAY VALVE FOR FLUIDS

BACKGROUND OF THE INVENTION

1. Field of the Invention

This invention relates to a one-way valve for fluids. In particular, one intended application of the valve is for use with gas lighters.

2. Description of the Prior Art

In conventional gas lighters the fuel which is generally stored in liquid form in a reservoir is generally selectively directed through a valve device in gaseous form, after which it arrives at a burner nozzle where it is ignited. The valve device generally consists of a hollow body of which one end has a bottom wall provided with an orifice to permit the passage of the gaseous fuel coming from the reservoir. The orifice can be selectively closed by a valve seal when the lighter is not in use.

The valve seal is generally provided at the base of the burner tube, which is equipped with a gasket in the form of a disc. The gasket is adapted to selectively close or open the orifice at will by the upward and downward movement of the nozzle and the burner tube. In fact, the burner tube, which normally includes a central channel which opens into at least one radial wall opening for the flow of the gas, is mounted in movable fashion within the body while it is normally biased toward the "valve closed" position by a resilient spring positioned beneath the finger operated lever of the lighter. The seal provided by a conventional valve of the type described generally depends essentially upon the characteristics of the gasket and the force of the resilient spring which is indirectly applied against the valve seat.

In general, since the seal is normally provided by engagement of the gasket with the valve seat over a single peripheral contact portion, sealing of the opening can be further enhanced by providing a plurality of contact portions to seal the opening. The present invention relates to a valve device for selectively passing fluids therethrough and which provides multiple sealing contact locations. One application of the valve device is for use with a gas lighter.

SUMMARY OF THE INVENTION

A valve for selectively permitting passage of fluid media which comprises valve body means having one end portion defining an inner wall surface having an endless cross-sectional configuration and having a substantially flat annular valve seat extending inwardly of the wall surface. Plug means is positioned for axial movement toward and away from the valve seat, and annular resilient seal means is positioned between the plug means and the valve seat and adapted to provide gaseous sealing contact between the plug means and the valve body means at least at a plurality of locations when the plug means is moved to a first closed position which prevents gaseous communication between the valve seat and the plug means.

In one application, a valve is provided for selectively permitting passage of gaseous fuel from a fuel supply to burner means which comprises valve body means having one end portion defining a substantially cylindrical inner wall surface and having a substantially flat annular valve seat extending inwardly of the wall surface. Plug means is positioned for axial movement toward and away from the valve seat, and annular resilient seal means is positioned between the plug means and the valve seat and adapted to provide gaseous sealing contact between the plug means and the valve body means at least at a plurality of locations when the plug means is moved to a first closed position which prevents gaseous communication between the fuel supply and the valve body.

The cylindrical inner wall surface of the valve body means adjacent the seal means is preferably of lesser dimension than the wall surface of the remaining portion of the valve body means. The narrowing of the inner wall surface where the seal means seats is provided along an axial length which is preferably at most equal to the corresponding dimension of the seal means in the closed position. Also, the cylindrical inner wall surface adjacent the seal means is preferably of axial length equal to or greater than the corresponding dimension of the seal means when the plug means is moved to the first closed position. The plug means comprises a disc-shaped head positioned adjacent the lower end of the valve body means, wherein the disc-shaped head is of diameter less than the cylindrical inner wall surface of the valve body means adjacent the resilient seal means.

The annular resilient seal means defines a central opening and the plug means comprises a member extending downwardly from the disc-shaped head and positionable within the central opening of the annular resilient seal means. Also, the axial length of the downwardly extending member positionable within the opening of the annular resilient seal means is less than the corresponding dimension of the opening of the seal means.

The reduced diameter cylindrical inner surface portion of the valve body means where the seal means sits is connected to the cylindrical surface of the remaining portion of the valve body means by an inner shoulder having a generally convex cross-sectional configuration adjacent the valve seat. Also, the resilient seal means comprises a toric shaped gasket fabricated of a resilient material and defining a central opening coaxial with an orifice in the body means, and the plug means comprises a generally cylindrical shaped member extending upwardly from the side of the disc-shaped head opposite the gasket. The cylindrical shaped member is attached to a member axially movable within the valve body means.

The plug means is positioned at the lower end portion of the axially movable member and the axially movable member is movable such that the plug means is movable therewith between a first closed position whereby the disc-like head compresses the toric shaped gasket to provide gaseous sealing contact between the gasket and the valve seat and a second open position which permits gaseous communication past the valve seat. The cylindrical inner surface portion of lesser dimension extends upwardly in a direction generally perpendicular to the valve seat and the extension comprises at least one axially extending channel in the inner wall portion of the valve body.

In an application to lighters, the axially movable member comprises an elongated burner tube having a generally cylindrical configuration wherein the burner tube has a generally axial elongated central opening which is preferably tapered. Further, the elongated member extending upwardly of the disc-shaped head is positioned within the central opening of the burner tube at the lower end thereof in a manner to attach the plug means to the burner tube for movement therewith toward and away from the valve seat. The member extending downwardly into the central opening of the annular seal means includes a portion which is substantially cylindrically shaped, and connected to the lower surface of the disc-like member of the plug means by a portion tapering inwardly toward the cylindrically shaped portion from the disc-like member.

The movable burner tube includes at least one radial extending opening which communicates with the axially extending channel for directing the flow of gaseous fuel therethrough. The cylindrical inner wall surface comprises means to provide gaseous communication from the substantially reduced diameter inner wall surface portion to the at least one radial extending opening in the inner tube and the gaseous communication means comprises a plurality of passageways extending from the reduced diameter inner wall surface upwardly toward the at least one radial opening in the inner tube. In one embodiment the passageways comprise a plurality of grooves in the cylindrical wall portion adjacent the reduced diameter inner wall portion. In another embodiment, the passageways comprise a plurality of axially extending spaces positioned between portions of the cylindrical inner wall surface above the reduced diameter inner wall surface. The extension may include a plurality of channels, grooves or annular spaces to provide gaseous communication to the burner tube.

In a preferred embodiment, the valve is adapted to be mounted to a gas lighter for selectively directing the passage of gaseous fuel between a fuel supply and a hollow burner tube. The burner tube has a nozzle at the upper end thereof whereby the gaseous fuel is selectively directed from the fuel supply toward the nozzle when the valve is in the open position and the valve is biased toward the closed position by a resilient spring device.

The gaseous sealing contact of the annular resilient seal ring is provided at least along two directions with respect to the seal ring, both radial and axial. Preferably, sealing contact is provided at least at four locations with respect to the seal ring to provide substantial sealing contact by substantial closing force.

The invention also relates to a fuel burning lighter which comprises, a reservoir supply of fuel, burner means communicating with the fuel supply, valve body means positioned between the fuel supply and the burner means, and annular seal means positioned between the burner means and the valve body means and seated coaxially with an orifice which communicates with the fuel supply reservoir. The seal means is adapted to provide gaseous sealing contact at a plurality of locations which prevent gaseous communication between the fuel supply reservoir and the burner means when the burner means is in a first position and permits gaseous communication therebetween when the burner means is moved to a second position. The plurality of gaseous sealing contact portions provide uniform force distribution with substantial total sealing force. The valve body means has one end portion defining a substantially cylindrical inner wall surface and a substantially flat annular valve seat extending inwardly of the wall surface. Plug means is positioned for axial movement toward and away from the valve seat, and annular resilient seal means is positioned between the plug means and the valve seat. The seal means is adapted to provide gaseous sealing contact between the plug means and the valve body means at least at a plurality of locations when the plug means is moved to a first closed position whereby the seal means is compressed so as to prevent gaseous communication between the valve seat and the plug means at more than one location.

BRIEF DESCRIPTION OF THE DRAWINGS

Preferred embodiments of the invention will be described hereinbelow with reference to the drawings wherein:

FIG. 2 is a perspective view with parts separated for illustration purposes, of the burner tube, the end plug and sealing gasket constructed according to the invention;

FIG. 2A is a perspective view with parts separated for illustration purposes, of the membrane and related retainer disc of the type generally incorporated into such valves;

FIG. 3 is an enlarged cross-sectional view of the valve device of the invention, incorporated into the lighter shown in FIG. 1, and illustrating further details of the invention;

FIG. 9 is a plan view from below of another alternative embodiment of the valve device of the invention;

FIG. 10 is a cross-sectional view taken along lines 10—10 of FIG. 9;

FIG. 11 is a cross-sectional view taken along lines 11—11 of FIG. 10;

FIG. 12 is an enlarged perspective view with parts separated for illustration purposes, of the alternative valve plug shown in FIG. 10; and FIG. 12A is an enlarged perspective view with parts separated for illustration purposes, of the membrane and related retainer disc of the type generally incorporated into such lighters.

DETAILED DESCRIPTION OF THE PREFERRED EMBODIMENTS

In the description which follows the valve device according to the invention is described in connection with a lighter which is operative by gaseous fuel. However, it should be understood that such valve devices according to the invention are applicable to uses other than lighters, in which case the lighter operative components may be substituted by components of such alternative environments. For example, in a lighter the burner tube 22 is movable as will be described hereinbelow to open and close the valve device. In such alternative environments, the burner tube may be substituted by a movable rod, for example.

Figure 1:
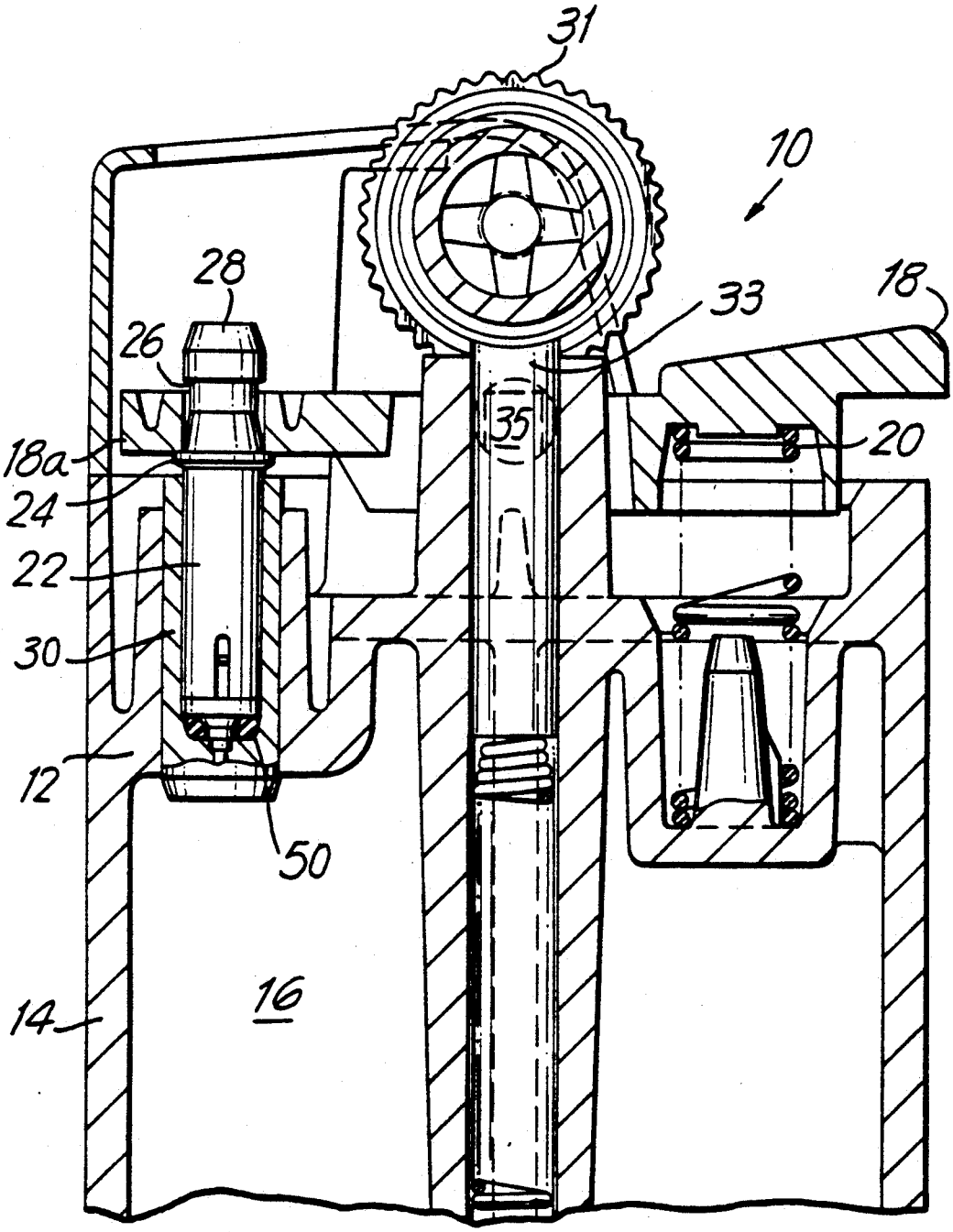
FIG. 1 is a cross-sectional view of the upper portion of a lighter with the valve device constructed according to the invention in the closed position.

Referring initially to FIG. 1, there is illustrated the upper operative portion of a lighter 10 which incorporates valve device 12 constructed according to the present invention. The lighter 10 includes lighter body 14 with fuel containing reservoir shown generally at 16. The valve device 12 is operated via finger operative lever 18 which is biased upwardly by coil spring 20 on the finger operative side. The lever 18 is pivotally mounted at 35 so as to normally assume a downwardly biased position on the valve device, i.e. the side opposite the finger operative side. The downward bias force is provided on burner tube 22 via annular rim 24 on the burner tube, causing the burner tube 22 and the valve device 12 at the lower end to move to the "valve closed" position and thereby block gaseous fuel communication between the reservoir 16 and the burner tube 22 and nozzle 28. When the finger operative lever 18 is depressed against spring 20, the forward extension 18*a* of lever 18 lifts the burner tube 22 and nozzle 28 via the annular rim 26 on the nozzle 28. The valve device 12 thereby opens at the lower end, thus permitting gaseous fuel to pass therethrough to the nozzle 28 where it is ignited by producing a spark with spark wheel 31 and a suitable spark producing flint 33. Alternative spark producing devices include piezoelectric devices.

Figure 4:
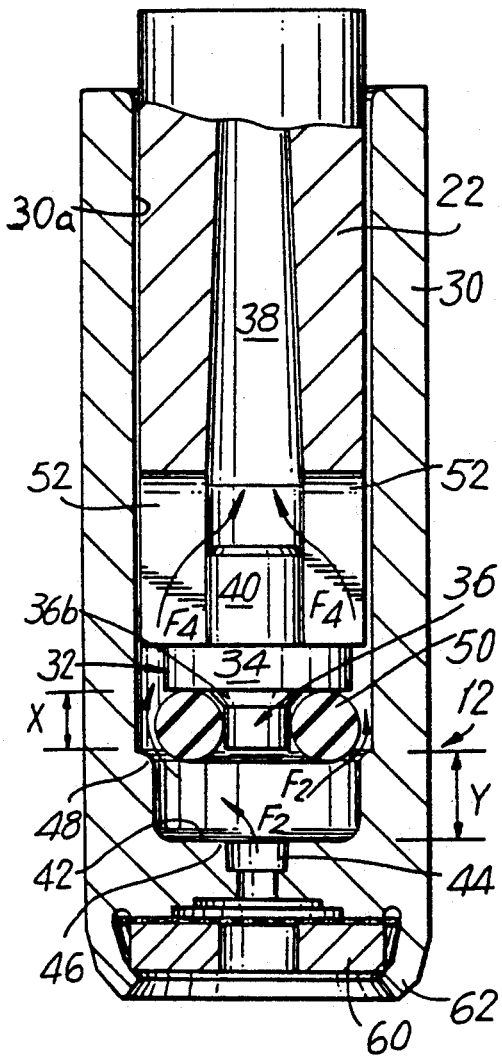
FIG. 4 is a cross-sectional view of the valve device of FIG. 3, illustrating one operative mode of opening the valve device.
Figure 5:
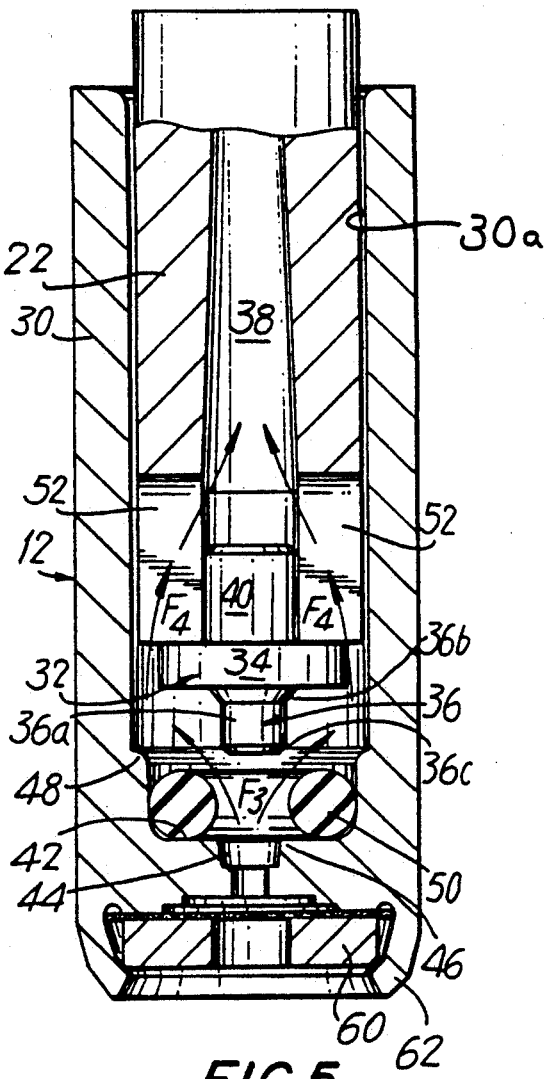
FIG. 5 is a cross-sectional view similar to FIG. 4, illustrating an alternative operative mode of opening the valve device.

The valve device according to the present invention will now be described. As shown in FIGS. 3–5, in conjunction with FIGS. 2 and 2A, the valve device 12 constructed according to the invention consists of a hollow cylindrical valve body 30 in which end plug 32 is mounted for axial movement with burner tube 22. The end plug 32 is fixed at the lower end of burner tube 22 and it has a flat annular head 34 at the center of which is positioned downwardly extending guide shaft 36 having a cylindrical outer surface. As is shown more particularly in FIGS. 3–5, the burner tube 22 is provided with an axial opening 38 for passage of gas from reservoir 16 to nozzle 28 shown in FIG. 1. The end plug 32 is attached to the burner tube 22 by upwardly extending shaft 40 formed integrally with disc-shaped annular head 34 and is securely attached by interference fit into the corresponding lower end of opening 38 of burner tube 22 as shown. Alternatively, end plug 32 may be attached to burner tube 22 by other mechanical techniques such as threading, bonding or heat melt techniques.

The valve body 30 has an annular bottom wall 42 having a central orifice 44 which forms a crown shaped valve seat 46. The dimension Y in FIG. 4 taken along an axial direction upwardly from the valve seat 46, defines a portion of the valve body 30 which exhibits a reduction in inner diameter as shown in the drawings. The inner walls of different diameters are connected through a shoulder 48 which is chamfered to slope inwardly and has a slightly rounded—or convex—shape as shown in FIGS. 3–5.

Referring once again to FIGS. 3–4, the valve seat 46 and the narrowed cylindrical inner wall portion Y are configured to receive annular seal ring 50 having a toric shaped configuration. The annular seal ring 50 is made of an elastomeric material such as synthetic or natural rubber.

The toric shaped seal ring 50 has a central opening which receives guide shaft 36 as shown. Further, it will be appreciated that the seal ring 50 can be substituted by any suitable annular gasket, the cross-section of which can be elliptical, square, rectangular or the like. In the case of a rectangular cross-section, for example, the gasket may be in the form of a thick elastomeric washer.

As is shown in FIG. 4, the length of the guide shaft 36 defined by dimension X has a smaller diameter than the diameter of the opening of the seal ring 50 whose own uncompressed diameter is less than or equal to the diameter of the reduced diameter inner cylindrical wall defined by axial length Y in FIG. 4. Furthermore, the outer diameter of the disc-shaped head 34 of the end plug 32 is smaller than the inner diameter of the valve body 30 and preferably less than the inner diameter of the relatively narrowed inner wall defined by dimension y in FIG. 4 at the lower end of the valve body 30. In addition, the diameter of the outer cylindrical surface of the guide shaft 36 is at least equal to or greater than the diameter of the central opening in the seal ring 50 when the seal ring is positioned within its seat as shown in FIG. 3 and when the seal ring is lifted out of its seat as shown in FIG. 4.

Referring now to FIGS. 2–5 a preferred embodiment for directing gaseous fuel from the reservoir 16 (FIG. 1) to the nozzle 28 (FIG. 1) is illustrated. The burner tube 22 has at least two radial openings 52 positioned diametrically opposite each other as best shown in FIG. 2. It is noted that at least one such opening may be utilized without departing from the invention. Each opening 52 is preferably oblong in shape and extends in the lower portion of the burner tube 22 from the lower end of the burner tube 22 which faces the disc-shaped head 34 of end plug 32 to a point above the upper end of shaft 40. The gaseous fuel arrives through the orifice 44 of valve body 30 and is prevented from further upward movement when the end plug 32 and seal ring 50 are in the positions shown in FIG. 3 with the guide shaft 36 positioned within the central opening of seal ring 50. The elastomer seal ring is in compression due to the downward force of the disc-shaped head 34 of valve plug 32 provided by spring 20 via burner tube 22. In the mode of operation of FIG. 4, the burner tube 22 and end plug 32 are moved upwardly such that seal ring 50 moves upwardly therewith thereby becoming unseated, and gaseous fuel is permitted to flow from reservoir 16 (FIG. 1) through orifice 44 around seal ring 50 and into axial opening 38 of burner tube 22 via oblong radial openings 52. This flow path is illustrated by arrows $F_2$ and $F_4$ in FIG. 4.

As seen in FIG. 3, the seal ring 50 is compressed, on the one hand axially between the disc-shaped head 34 and the valve seat 46 of the valve body 30, and on the other hand radially between the guide shaft 36 and the relatively narrowed inner cylindrical wall Y of the lower portion of the valve body 30 as shown. In order to facilitate the introduction of the guide shaft 36 and improve its contact with the seal ring 50, as is best shown in FIGS. 4 and 5, the guide shaft 36 has a cylindrical part 36*a* which connects with the annular disc-shaped 34 by a tapering part 36*b*. The outer extremity of the cylindrical part 36*a* of guide shaft 36 is also chamfered at the lower end 36*c* as shown.

As can be seen clearly in the Figures, particularly FIG. 3, the valve device constructed according to the invention provides a double seal, namely an axial seal at E1′ and E2 and a radial seal at E1 and E2′. The references E1, E1′, E2 and E2′ schematically represent the seal surface portions, considering these references as representing annular surfaces or at least circular lines of contact. Thus, for gaseous fuel to pass from fuel supply reservoir 16 to burner tube 22, it must pass a plurality of seal portions, such as seal portions E1′ and E1, or E2′ and E2. Hence a double seal is assured along two distinct axes as shown. Clearly, the multiple sealing surfaces provide enhanced sealability between the fuel supply reservoir 16 and the burner nozzle 28. For example, the seal paths shown thus assume that for gaseous fuel to pass the contact portion E1, the fuel must first pass contact portion E1'. Further, for fuel to pass contact portion E2 it must first pass E2'.

In the embodiment of FIG. 4, the relevant dimensions are selected such that when burner tube 22 is moved axially in the upward direction, the end plug 32 as well as seal ring 50, moves with the burner tube in the direction away from the valve seat 46 as shown. In the embodiment of FIG. 5, the relevant dimensions are selected such that axial upward movement of burner tube 22 results in upward movement of only end plug 32, while seal ring 50 remains in the position shown. Entry and reentry of shaft 36 into the central opening of seal ring 50 is facilitated by chamfered end 36C. In the embodiment of FIG. 4 gaseous fuel is permitted to pass from the reservoir 16 (FIG. 1) past the outer periphery of seal ring 50 into radial extending apertures 52 and opening 38 of burner tube 22 via arrows $F_2$ and $F_4$. In the embodiment of FIG. 5, gaseous fuel passes from reservoir 16 through the central opening of seal ring 50 into radial extending apertures 52 of burner tube 22. In either case the fuel travels from the reservoir 16 to the nozzle 28.

The structural differences between the embodiments shown in FIGS. 4 and 5 clearly reside in the dimensions selected for these components. The selection of the relevant dimensions determines the mode of operation of the valve device 12. For example, in FIG. 4, the uncompressed outer diameter of seal 50 is equal to, or slightly less than the dimension of the reduced diameter of the cylindrical wall portion defined by axial dimension Y, whereas in the embodiment of FIG. 5 the uncompressed outer diameter of seal ring 50 is slightly greater than the surrounding reduced diameter of the cylindrical wall Y causing the seal to remain in the position shown at all times. Further, in FIG. 4 the diameter of guide shaft 36 may be such as to provide sufficiently snug fit into seal ring 50 to lift the seal ring 50 when the valve device 12 is opened.

As noted, in FIG. 5, the relevant dimensions are such that guide shaft 36 is withdrawn from the seal ring 50 and as noted, the seal ring 50 remains in the seated position at all times. Numerous variations of the relevant dimensions can be envisioned and incorporated to accomplish the desired mode of operation without departing from the scope of the invention.

Referring once again to FIG. 4, the seal ring 50 remains on the guide shaft 36 while the fluid coming from the orifice 44 can travel around the seal ring 50 in the direction of arrow $F_2$, owing in particular to the fact that the seal ring 50 has withdrawn from the narrowed cylindrical portion Y of the valve body 30. As noted, the fluid can then flow through into opening 38 of the burner tube 22 after it has passed the radial extending apertures extending 52 strated by arrows $F_4$ in FIG. 4.

In FIG. 5, the seal ring 50 remains in position and the gas can then travels in the direction of arrows $F_3$, through the inside of the seal ring 50. Then, the flow of fluid can take place as already described in connection with FIG. 4, i.e. through apertures 52 and into opening 38 and upward as illustrated by arrows $F_4$ in FIGS. 4 and 5.

Moreover, whether the dimensions are selected either as in FIG. 4 or as in FIG. 5, it is clear that the burner tube 22 must travel a minimum distance in order to completely disengage the guide shaft 36 as in FIG. 5, or the seal ring 50 as in FIG. 4.

Figure 6:
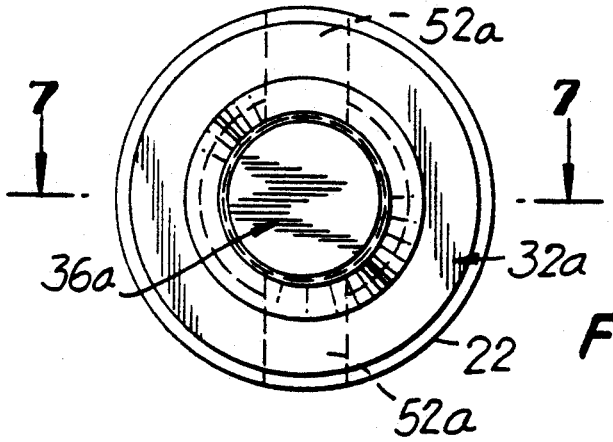
FIG. 6 is a plan view from below of an alternative embodiment of the valve device constructed according to the invention.
Figure 7:
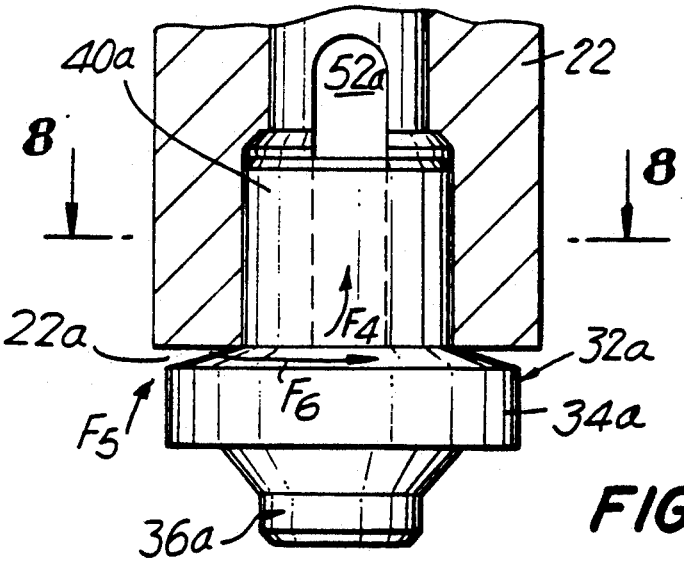
FIG. 7 is a cross-sectional view of the valve device of FIG. 6 taken along lines 7—7 of FIG. 6.
Figure 8:
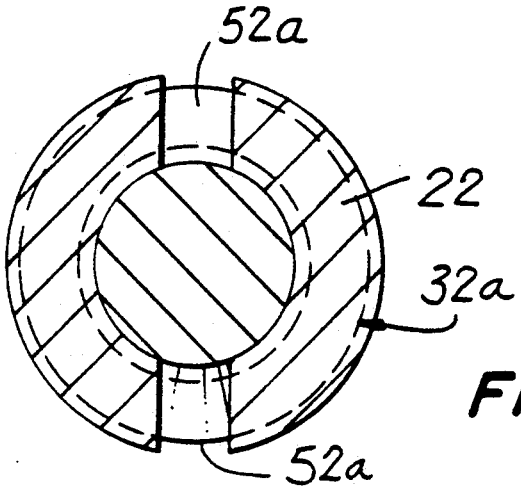
FIG. 8 is a cross-sectional view of the valve device of FIG. 7 taken along lines 8—8.

FIGS. 6–8 illustrate an alternative embodiment of the invention wherein the modified like compartments are numbered similar to the previous embodiments with the addition of the letter "a" where appropriate. In FIGS. 6–8, the disc shaped head 34*a* of end plug 32*a* has a tapered upper surface which is substantially frusto-conical and connected to shaft 40*a*. FIG. 8 is a cross-sectional view taken along lines 8—8 of FIG. 7 illustrating the radial apertures 52*a* in burner tube 22 which communicate with the central opening 38 of burner tube 22. In particular, in the embodiment of FIGS. 6–8, the frusto-conical shaped upper surface creates a circular gaseous flow path with the lower end portion of burner tube 22 by defining an angular space 22*a* as shown in FIG. 7. This flow path enhances the vortex movement of the gaseous fuel thus further enhancing the flow of fuel into radial apertures 52*a* and up to nozzle 28 as shown by arrows $F_5$, $F_6$ and $F_4$ in FIG. 7.

Referring now to FIGS. 9–12 an alternative embodiment is illustrated wherein further modified like components are numbered similar to the previous embodiments with the addition of the letter "b" where appropriate. In FIGS. 9–12, selective communication between the gaseous fuel reservoir 16 (FIG. 1) of lighter 10 and the inner opening 38*b* of burner tube 22*b* is provided by an aperture 54 in end plug 34*b* configured as shown. In particular, the aperture 54 is substantially "J" shaped as best shown in FIGS. 10 and 12, and communicates gaseous fuel which passes seal ring 50 into the lower portion of the aperture 54 and up into the inner opening 38*b* of burner tube 22*b*.

The mode of operation of the embodiment of FIGS. 9–12 involves the feature of providing the opening 54 in the end plug 32*b*, which opens at one end, into the periphery of the head 34*b* and at the other end, into the inner opening 38*b* of the burner tube 22*b* following substantially the axis of the upwardly extending shaft 40*b* as shown. It is clear that the aperture 54 (optionally several may be provided) replaces the apertures 52 disclosed in connection with the previous embodiments.

Furthermore, in the mode of operation of the embodiment of FIGS. 9–12, the narrowed cylindrical portion Y of the body 30 is perpendicular to the seat 46*b*, and an extension 57 is thus formed and provided with passageways in the form of grooves 56 as shown. The grooves 56 appear in the form of channels, here longitudinal and selectively numbered four, which are formed in the inner wall of the body 30. Thus, the narrowed portion is provided along a longer axial length than in the previous embodiments while the grooves 56 are provided along a portion of the length, starting from the side opposite the seat 46*b*. Furthermore, in FIG. 11, the grooves 56 are shown convex facing outwardly. Such grooves may be replaced by a plurality of spaced ribs, with the convex side facing inwardly and sufficient in number to uniformly support the annular seal such that fuel will flow upwardly through passageways between the ribs.

The function of extension 57 shown in FIG. 10 and of grooves 56 is clear. For the mode of operation of the type shown in FIG. 4 to be incorporated into the structure of FIG. 10, the grooves 56 would allow the fluid to flow upwardly while the extension prevents the seal 50 from expanding outwardly during the valve opening movement and guides it during the subsequent closing operation.

As mentioned, the invention may have several end use applications. In one preferred application to gas lighters, as described above, it is understood that the burner tube 22 includes the nozzle 28 with the valve opening movement being controlled by pivotal lever 18 as shown in FIG. 1. In this embodiment valve device 12 is closed when burner tube 22 is pushed towards the "valve closed" position by an elastic device such as resilient spring 20. Furthermore, the valve body 30 may be fixed within the lighter body 14 adjacent the reservoir by interference fit with a suitably dimensioned opening in the lighter body 12.

FIG. 1 represents one preferred application of the invention to such liquefied gas lighters. Hence the reason for the shape of the burner 22 whose outer diameter is close to the inner diameter of the valve body 30. For other non-lighter applications, burner tube 22 could be narrower and without grooves and may be in the form of an elongated rod or a dispensing tube for dispensing any suitable liquid or gaseous media.

For the application to gas lighters, as shown in FIGS. 1-3, the lower end of the valve body 30 is provided with orifice 44, under which is provided a flow restricting membrane 58 held in place by a disc 60 shown in FIG. 12. Disc 60 may be made of any suitable metal and may be secured in position as shown at the extremity of the valve body 30 by crimping the rim 62 of the valve body. One material of which disc 60 may be made is aluminum. The flow restricting membrane 58 and disc 60 are best shown in FIGS. 2 and 12. In these Figures, the web section forming the seat of the valve body 30 is not shown for convenience of illustration.

In addition, though the particular application described herein involves a fixed flame lighter, the invention applies equally as well to adjustable flame lighters equipped for example with a compressible filter.

In general, although the invention has been described in connection with a lighter, it is clear that the improved valve is applicable to end uses of all types wherein a fluid in liquid or gaseous form is to be selectively passed from one location to another and where capability to selectively block the passage of the media is required. The present invention is applicable to all such end uses.

I claim:

1. A valve for fuel burning lighter for selectively permitting passage of fluid fuel from fuel supply means which comprises:

a) valve body means having one end portion defining a continuous inner wall surface and having an annular valve seat extending inwardly of said wall surface and fuel passageway means communicating with said fuel supply means;

b) plug means positioned within said valve body means for axial movement toward and away from said annular valve seat;

c) annular resilient seal means positioned between said plug means and said annular valve seat to provide sealing contact at a plurality of adjacent locations between said plug means and said annular seal means and at at least one location between said annular seal means and said continuous inner wall surface and at at least one location between said seal means and said annular valve seat when said plug means is moved toward said annular valve seat to a first position in which said seal means is in a closed position which prevents fuel passage between said valve body means and said plug means;

d) burner means defining an inner opening and having two opposed end portions, a first of said end portions connected to said plug means, the second end portion adapted for directing said fuel for burning; and e) means associated with said plug means and said burner means for directing fuel from said fuel passageway means toward said inner opening of said burner means.

2. A valve for a fuel burning lighter for selectively permitting passage of fuel from fuel supply means to burner means which comprises:

a) valve body means having one end portion defining a substantially cylindrical inner wall surface and having a substantially flat annular valve seat extending inwardly of said wall surface and fuel passageway means communicating with said fuel supply means;

b) plug means positioned within said valve body means and movably axially toward and away from said annular valve seat;

c) annular resilient seal means positioned between said plug means and said annular valve seat to provide substantially the same plurality of sealing contact surfaces between said plug means and said annular resilient seal means as between said annular resilient seal means said valve body means when said plug means is moved axially to a first position whereby said annular resilient seal means is in a closed position which prevents fuel passage between said fuel supply means and said annular resilient seal means;

d) burner means defining an inner opening and having two opposed end portions, one of said end portions connected to said plug means;

e) means associated with said plug means and said elongated burner means for directing fuel from said fuel passageway means toward said inner opening of said burner means; and f) nozzle means positioned at the other end portion of said burner means for reception of said fuel from said burner means inner opening to be burned.

3. The valve according to claim 2 wherein said substantially cylindrical inner wall surface of said valve body means adjacent said seal means is of lesser dimension than the wall surface of the remaining portion of said valve body means.

4. The valve according to claim 3 wherein said substantially cylindrical inner wall surface adjacent said seal means is of axial length equal to or greater than the corresponding dimension of said seal means when said plug means is moved to said first closed position.

5. The valve according to claim 2 wherein said plug means comprises a disc-shaped head positioned adjacent the lower end of said valve body means.

6. The valve according to claim 5 wherein said disc-shaped head is of diameter less than said cylindrical inner wall surface of said valve body means adjacent said resilient seal means.

7. The valve according to claim 6 wherein said annular resilient seal means defines a central opening and said plug means comprises a member extending downwardly from said disc-shaped head and positionable within said central opening of said annular resilient seal means.

8. The valve according to claim 7 wherein the axial length of said downwardly extending member positionable within said opening of a annular resilient seal means is less than the corresponding dimension of said opening of said seal means.

9. The valve according to claim 8 wherein said reduced diameter cylindrical inner surface portion of said valve body means adjacent said seal means is connected to said cylindrical surface of the remaining portion of said valve body means by an inner shoulder.

10. The valve according to claim 9 wherein said inner shoulder has a generally convex cross-sectional configuration adjacent said valve seat.

11. The valve according to claim 10 wherein said resilient seal means comprises a toric shaped gasket fabricated of a resilient material and defining a central opening.

12. The valve according to claim 11 wherein said plug means comprises a generally cylindrical shaped member extending upwardly from the side of said disc-shaped head opposite said gasket and said cylindrical member is attached to a member axially movable within said valve body means.

13. The valve according to claim 12 wherein said plug means is positioned at the lower end portion of said axially movable member and said axially movable member is movable such that said plug means is movable therewith between a first closed position whereby said disc-like head compresses said toric shaped gasket to provide gaseous sealing contact between said gasket and said valve seat and a second open position which permits gaseous communication past said valve seat.

14. The valve according to claim 13 wherein said cylindrical inner surface portion of lesser dimension extends upwardly in a direction generally perpendicular to said valve seat and said extension comprises at least one axially extending channel in said inner wall portion of said valve body.

15. The valve according to claim 14 wherein said axially movable member comprises an elongated burner tube having a generally cylindrical configuration.

16. The valve according to claim 15 wherein said burner tube has a generally axial elongated tapered central opening.

17. The valve according to claim 16 wherein said elongated member extending upwardly of said disc-shaped head is positioned within said central opening of said burner tube at the lower end thereof in a manner to attach said plug means to said burner tube for movement therewith toward and away from said valve seat.

18. The valve according to claim 17 wherein said member extending downwardly into said central opening of said annular seal means includes a portion which is substantially cylindrically shaped, said cylindrically shaped portion being connected to the lower surface of said disc-like member of said plug means by a portion tapering inwardly toward said cylindrically shaped portion from said disc-like member.

19. The valve according to claim 18 wherein said movable burner tube includes at least one radial extending opening which communicates with said axially extending channel for directing the flow of gaseous fuel therethrough.

20. The valve according to claim 19 wherein said cylindrical inner wall surface comprises means to provide gaseous communication from said substantially reduced diameter inner wall surface portion to said at least one radial extending opening in said burner tube.

21. The valve according to claim 20 wherein said gaseous communication means comprises a plurality of passageways extending from said reduced diameter inner wall surface upwardly toward said at least one radial opening in said inner tube.

22. The valve according to claim 21 wherein said passageways comprise a plurality of grooves in said cylindrical wall portion adjacent said reduced diameter inner wall portion.

23. The valve according to claim 21 wherein said passageways comprise a plurality of axially extending spaces positioned between portions of said cylindrical inner wall surface adjacent said reduced diameter inner wall surface.

24. The valve according to claim 1 adapted to be mounted to a gas lighter for selectively directing the passage of gaseous fuel between a fuel supply and a hollow burner tube, said burner tube having a nozzle at the upper end thereof whereby said gaseous fuel is selectively directed from said fuel supply toward said nozzle when said valve is in the open position and said valve being biased toward the closed position by a resilient spring device.

25. A valve for a fuel burning lighter selectively permitting passage of gaseous fuel from fuel supply means to burner means which comprises:

a) a valve body having a substantially cyulindrical inner wall surface having at the lower end portion a second substantially cylindrical inner wall surface of relatively reduced diameter, said valve body having an annular valve seat extending generally radially inwardly of said second substantially cylindrical wall surface and defining a fuel passageway for passage of fuel from said fuel supply means;

b) an annular resilient seal member positioned within said portion of said valve body defined by said second substantialliy cylindrical wall surface of reduced diameter;

c) an end plug positioned above said annular resilient seal member and movable between a first closed position which provides sealing contact at at least two distinct surface portions between said end plug and said annular resilient seal member and at at least one distinct surface portion between said annular resilient seal member and said inner wall surface and between said annular resilient seal member and said annular valve seat which sealing contacts prevent fuel communication from said fuel supply means past said seal member, and a second position wherein said end plug is moved away from said valve seat whereby fuel passage from said fuel supply past said seal member is permitted;

d) an elongated burner tube defining an inner opening for reception of gaseous fuel from said fuel passageway and having two opposed end portions, one of said end portions connected to said end plug;

e) means associated with said elongated burner tube and said end plug for permitting fuel communication between said fuel supply means and said elongated burner tube inner opening; and f) nozzle means positioned at the other end portion of said elongated burner tube for reception of said fuel from said burner tube to be burned.

26. A valve for a fuel burning lighter for selectively permitting passage of fuel from fuel supply means which comprises:

a) valve body means having one end portion defining a substantially cylindrical inner wall surface and having a substantially flat annular valve seat extending inwardly of said inner wall surface in a manner to define a fuel passage opening communicating with said fuel supply means;

b) an end plug positioned for axial movement inward and away from said valve seat, said end plug having a disc-like head having a substantially cylindrically shaped member extending from said disc-like head toward said annular valve seat;

c) annular resilient seal means defining a central opening for reception of said substantially cylidnrically shaped member when said end plug is moved toward said annular resilient seal means and said seal means is compressed in a first direciotn between a surface portion of said disc-like head of said end plug and a surface portion of said flat annular valve seat and in a second direction between a surface portion of said substantially cylindrically shaped member of said end plug and a surface portion of said substantially cylindrical inner wall surface whereby gaseous sealing contact is provided between said end plug and said valve body means at a plurality of adjacent series locations to prevent fuel passage from said fuel supply means past said annular resilient seal means; said fuel from said burner means inner opening to be burned.

27. The valve according to claim 26 wherein said gaseous sealing contact is provided at least at two locations with respect to said seal means.

28. The valve according to claim 27 wherein said sealing contact is provided at least at four locations with respect to said seal means.

29. A fuel burning lighter which comprises:

a) a supply of fuel;

b) valve means positioned between said fuel supply and said burner means, said valve means comprising:

i) valve body means having one end portion defining a substantially cylindrical inner wall surface and having a substantially flat annular valve seat extending inwardly of aid wall surface, said valve body means defining fuel passageway means communicating with said supply of fuel;

ii) elongated burner means having two end portions and defining an inner opening for reception of fuel to be burned;

iii) plug means connected at one portion of said burner means for axial movement therewith toward and away from said valve seat, said plug means having at least two distinct surface portions;

annular resilient seal means positioned between said plug means and said valve seat and adapted to provide fuel sealing contact between said plug means and said annular resilient seal means at said at least two distinct surface portions, and at at least one surface portion between said annular resilient seal means and said inner wall surface and at at least one surface portion between said annular resilient seal means and said annular valve seat when said plug means is moved to a first position in which said seal means is in a closed position whereby said seal means is compressed so as to prevent fuel passage at more than one location from said supply of fuel past said seal means;

v) means associated with said elongated burner means and said plug means to permit passage of fuel between said supply of fuel and said burner means when said plug means is moved away from said annular valve seat; and vi) nozzle means positioned at the other end portion of said burner means and having means for reception of said fuel from said burner means inner opening for burning.

30. A valve for a fuel burning lighter for selectively permitting passage of fluid fuel media from a fuel supply toward nozzle means which comprises:

a) valve body means having one end portion defining a continuous inner wall surface and having a substantially flat annular valve seat extending inwardly of said wall surface, said valve body means defining fuel passageway means communicating with said fuel supply;

b) burner means having two end portions and defining an inner opening for reception of fuel to be burned;

c) plug means connected to one end portion of said burner means for axial movement therewith toward and away from said valve seat;

d) annular resilient seal means positioned between said plug means and said valve seat and adapted to provide sealing contact between said plug means and said annular resilient seal means at at least two distinct locations and at at least one distinct location between said annular resilient seal means and said inner wall surface and at at least one distinct location between said annular resilient seal means and said annular valve seat of said valve body means when said plug means is moved to a first position in which said seal means is in a closed position which prevents fuel passage between said fuel supply and said burner means;

e) means associated with said burner means and said plug means to permit passage of fuel between said fuel supply and said burner means when said plug means is moved away from said valve seat; and f) nozzle means positioned at the other end portion of said burner means for reception of said fuel from said inner opening of said burner means to be burned.

* * * * *

UNITED STATES PATENT AND TRADEMARK OFFICE

CERTIFICATE OF CORRECTION

PATENT NO. : 5,277,577

DATED : January 11, 1994

INVENTOR(S) : Friedrich Schächter and Michel Doucet

It is certified that error appears in the above-identified patent and that said Letters Patent is hereby corrected as shown below:

On the title page, in [75] Inventors:

Friedrich Schachter should read

Friedrich Schächter

Signed and Sealed this

Twenty-eighth Day of June, 1994

Attest:

Bruce Lehman

BRUCE LEHMAN

Attesting Officer

Commissioner of Patents and Trademarks

UNITED STATES PATENT AND TRADEMARK OFFICE

CERTIFICATE OF CORRECTION

PATENT NO. : 5,277,577

DATED : January 11, 1994

INVENTOR(S) : Friedrich Schächter and Michel Doucet

It is certified that error appears in the above-indentified patent and that said Letters Patent is hereby corrected as shown below:

Column 5, line 44, after "valve body 30" insert --defines elongated cylindrical opening 30a and--;

Column 5, line 46, change "Y" to --Y--;

Column 6, line 9, change "y" to --Y--;

Column 6, line 19, after "Burner tube 22" insert-- is positioned within cylindrical opening 30a and--;

Column 6, line 53, before "34" insert --head--;

Column 6, line 56, change "Figures" to --Figs.--;

Column 7, line 58, change "strated" to --as illustrated --.

Column 7, line 60, delete "can";

Column 9, line 15, change "liquefied" to --liquified --.

Column 9, line 31, change "Figures" to --Figs.--;

Column 9, line 46, insert --a-- between "for" and "fuel" in Claim 1;

Column 9, line 56, before the semi-colon, insert --, said plug means having at least two distinct outer surface portions-- in Claim 1;

UNITED STATES PATENT AND TRADEMARK OFFICE

CERTIFICATE OF CORRECTION

PATENT NO. : 5,277,577

DATED : January 11, 1994

INVENTOR(S) : Friedrich Schächter and Michel Doucet

It is certified that error appears in the above-indentified patent and that said Letters Patent is hereby corrected as shown below:

Column 9, lines 59-60, delete the phrase "at a plurality of adjacent locations" from Claim 1;

Column 9, line 61, between "means" and "and" insert --at least at said at least two distinct outer surface portions of said plug means-- in Claim 1;

Column 10, line 21, before the semi-colon insert --, said plug means having at least two distinct outer surface portions-- in Claim 2;

Column 10, line 24, change "substantially the same plurality of" to --continuous annular-- in Claim 2;

Column 10, line 25, delete "surfaces" from Claim 2;

Column 10, line 26, delete "annular resilient" from Claim 2;

Column 10, lines 26-27, change "as between said annular resilient seal means and said valve body means" to --at least at said at least two distinct surface portions of said plug means and between said seal means and said valve body means at at least two distinct surface portions of said valve body means-- in Claim 2;

Column 10, line 29, delete "annular resilient" from Claim 2;

Column 10, lines 31-32, delete "annular resilient" from Claim 2;

Column 10, line 68, change "a" to --said-- in Claim 8;

UNITED STATES PATENT AND TRADEMARK OFFICE

CERTIFICATE OF CORRECTION

PATENT NO. : 5,277,577

DATED : January 11, 1994

INVENTOR(S) : Friedrich Schächter and Michel Doucet

It is certified that error appears in the above-indentified patent and that said Letters Patent is hereby corrected as shown below:

Column 11, line 3, change "said" to --a-- in Claim 9;

Column 12, line 24, change "cyulindrical" to --cylindrical-- in Claim 25;

Column 12, line 38, between "and" and "movable" insert --having at least two distinct outer surface portions, said plug means being-- in Claim 25;

Column 12, lines 39-40, delete "at at least two distinct surface portions" from Claim 25;

Column 12, line 41, between "member" and "and" insert --at said at least two distinct outer surface portions of said end plug-- in Claim 25;

Column 12, line 44, between "and" and "between" insert --at at least one distinct surface portion-- in Claim 25;

Column 13, line 3, change "inward" to --toward-- in Claim 26;

Column 13, line 9, change "cylidnrically" to --cylindrically-- in Claim 26;

Column 13, line 12, change "direciotn" to --direction-- in Claim 26;

UNITED STATES PATENT AND TRADEMARK OFFICE

CERTIFICATE OF CORRECTION

PATENT NO. : 5,277,577

DATED : January 11, 1994

INVENTOR(S) : Friedrich Schächter and Michel Doucet

It is certified that error appears in the above-indentified patent and that said Letters Patent is hereby corrected as shown below:

Column 13, line 23, between the semi-colon and "said" insert:

--d) burner means defining an inner opening and having two opposed end portions, one end portion connected to said end plug;

e) means associated with said burner means and said end plug to permit fuel communication between said fuel supply means and said burner means; and f) nozzle means positioned at the other end portion of said burner means for reception of-- in Claim 26;

UNITED STATES PATENT AND TRADEMARK OFFICE

CERTIFICATE OF CORRECTION

PATENT NO. : 5,277,577

DATED : January 11, 1994

INVENTOR(S) : Friedrich Schächter and Michel Doucet

It is certified that error appears in the above-indentified patent and that said Letters Patent is hereby corrected as shown below:

Column 13, line 40, change "aid" to --said-- in Claim 29;

Column 13, line 49, between distinct" and "surface" insert --outer-- in Claim 29;

Column 13, line 51, before "annular" insert --iv)-- in Claim 29;

Column 13, line 55, between "distinct" and "surface" insert --outer-- in Claim 29, and Column 14, lines 38-39 change "at at least two distinct locations" to --at least at said at least two distinct outer sealing faces of said plug means-- in Claim 30.

Signed and Sealed this

Twenty-fourth Day of June, 1997

Bruce Lehman

*Attest:*

BRUCE LEHMAN

*Attesting Officer*

*Commissioner of Patents and Trademarks*